US005929567A

United States Patent [19]

Kang et al.

[11] Patent Number: 5,929,567

[45] Date of Patent: Jul. 27, 1999

[54] CONSTANT FIELD GRADIENT PLANAR COUPLED CAVITY STRUCTURE

[75] Inventors: Yoon W. Kang, Naperville; Robert L. Kustom, Oswego, both of Ill.

[73] Assignee: The United States of America as represented by the United States Department of Energy, Washington, D.C.

[21] Appl. No.: 08/792,008

[22] Filed: Jan. 31, 1997

[51] Int. Cl.[6] ..... H01J 23/18

[52] U.S. Cl. ..... 315/5.39; 315/5.41

[58] Field of Search ..... 315/5.41, 5.42, 315/5.39, 500, 505

[56] References Cited

U.S. PATENT DOCUMENTS

| | | | |
|---|---|---|---|
| 2,487,656 | 11/1949 | Kilgore | 315/4 X |
| 4,409,519 | 10/1983 | Karp | 315/3.5 |
| 4,578,620 | 3/1986 | James et al. | 315/3.5 |
| 4,586,009 | 4/1986 | James | 315/3.5 |

*Primary Examiner*—Benny T. Lee

*Attorney, Agent, or Firm*—Daniel D. Park; Thomas G. Anderson; William R. Moser

[57] ABSTRACT

A cavity structure having at least two opposing planar housing members spaced apart to accommodate the passage of a particle beam through the structure between the members. Each of the housing members have a plurality of serially aligned hollows defined therein, and also passages, formed in the members, which interconnect serially adjacent hollows to provide communication between the hollows. The opposing planar housing members are spaced and aligned such that the hollows in one member cooperate with corresponding hollows in the other member to form a plurality of resonant cavities aligned along the particle beam within the cavity structure. To facilitate the obtaining of a constant field gradient within the cavity structure, the passages are configured so as to be incrementally narrower in the direction of travel of the particle beam. In addition, the spacing distance between the opposing housing members is configured to be incrementally smaller in the direction of travel of the beam.

15 Claims, 8 Drawing Sheets

CONSTANT FIELD GRADIENT PLANAR COUPLED CAVITY STRUCTURE

CONTRACTUAL ORIGIN OF THE INVENTION

The United States Government has rights in this invention pursuant to Contract No. W-31-109-ENG-38 between the U.S. Department of Energy and the University of Chicago.

BACKGROUND OF THE INVENTION

The present invention relates to radio-frequency (rf) resonant cavities, and more particularly, to a cavity structure having generally planar members which cooperatively define multiple, serially aligned and coupled resonant cavities with a constant electric field gradient.

Radio-frequency, resonant cavity structures are found in charged particle accelerators, undulators, free electron lasers, oscillators, amplifier tubes and communication signal filters. As these devices continue to find wider application in various fields, such as medicine and industry, it is important to be able to manufacture resonant cavity structures which are compact and precise, yet easy and inexpensive to fabricate. This requirement is especially important in linear, charged particle accelerators, wherein hundreds or even thousands of resonant cavities, as well as the numerous accelerator structures containing the cavities, must be precisely fabricated and aligned.

In conventional accelerator structures, resonant cavities are generally cylindrical in shape and require extensive machining, as well as subsequent assembly and alignment. However, for resonant cavities which operate at high frequencies (wavelengths of only a few millimeters), the fabrication of these cylindrical structures by conventional machining and brazing methods is extremely difficult and expensive because of the precise tolerances and specifications that are required. Additionally, because the cavities are normally aligned and joined by standard welding and brazing methods, frequent tunings and adjustments are necessary. These problems become even more exacerbated in applications such as linear accelerators, wherein hundreds or thousands of identical and precise resonant cavities must be manufactured and aligned.

One method of producing inexpensive and precise resonant cavities is to mass produce them using deep x-ray lithography (DXL) microfabrication techniques such as Lithography Galvanoformung Abformung (LIGA). In this method, x-rays are used to expose a predetermined pattern on a relatively thick layer of resist such as poly (methylmethacrylate), PMMA, which overlays a substrate. Next, after the areas of the PMMA which have been exposed are removed, metal is electroplated into the vacated areas. Then, the remaining PMMA is removed to leave a generally planar member having indentations or hollows of a predetermined pattern. A plurality of these members are then engaged to produce an accelerator structure having multiple resonant cavities.

The advantages of manufacturing such planar accelerator structures is that they can be mass produced with excellent precision, as the uniformity of the hollows can be within a few hundred angstroms. The structures do not require extensive assembly or tuning, and the materials from which the accelerator structure can be made is more diverse since no machining is involved.

In FIGS. 1(*a*), 1(*b*), and 1(*c*) is shown a generally planar housing member 10 (see FIG. 1(*a*)) produced by the microfabrication technique as described above. The member 10 has a plurality of rectangularly shaped hollows 11, which are positioned in a linear, serial fashion. In FIGS. 2(*a*), 2(*b*), and (*c*) is shown an accelerator structure 20 formed by placing two members 10, using spacers 22 for alignment (best seen in FIG. 2(*a*)), in such a manner so as to allow the hollows 11 see FIG. 2(*b*) and 2(*c*) to cooperatively form generally cubically shaped resonant cavities 21 (see FIG. 2(*b*)). The cavities 21, when subjected to rf waves, are coupled so as to provide acceleration to a charged particle traveling generally along a longitudinal axis through the cavities 21.

The accelerator structure 20 shown in FIGS. 2(*a*), 2(*b*), and (*c*) is of the constant impedance type, wherein the electric field gradient within the structure 20 varies along the longitudinal axis of the structure 20. Because of its uniform pattern, such a structure 20 is simple to fabricate, but is not the most optimal for accelerator applications, because of heat loading at the rf input stages which limits the total power that can be applied to the accelerator structure 20.

For accelerator applications, constant field gradient type structures have been preferred because of its higher energy gain and better frequency characteristics. Such structures have more uniform power dissipation, higher shunt impedance and is less sensitive to frequency deviations and beam break-up when compared to comparable constant impedance structures.

In conventional, circularly cylindrical accelerator structures, a constant gradient structure can be achieved by varying the dimensions of the resonant cavities and the coupling apertures. However, it is more difficult to construct a constant gradient structure using the DXL lithographic techniques as described above, since the depth of the hollows 11 created by such processing will be identical and normally cannot be varied. Using lithographic processing, cavity 21 dimensions can be varied by changing the width and length, or shapes, of the hollows 11. However, simulations have shown that such shape changes alone are not sufficient to produce good cavity coupling at constant operating frequencies and are unsuitable for achieving high accelerating voltages.

A simple method of varying the coupling, or the vertical dimensions, of the cavities 21 is to positions the members 10 in such a fashion so as to vary the distance between two members 10 as shown in FIG. 3. In this method, the vertical distance, D, between the members is varied along a beam direction, z, such that D is made increasingly smaller along the beam direction, z in an axis, y, perpendicular to the z direction. This structure 30, as shown in FIG. 3, is able to produce a field gradient which is somewhat more constant than the simple structure shown in FIG. 2. However, this structure 30 is difficult to align correctly, especially when constructing multiple member structures, and is not very efficient in producing high field gradients.

In view of the foregoing, the general object of this invention is to provide a rf cavity structure which is cheap and easy to manufacture and yet is efficient and can achieve high operating voltages and constant field gradients.

Another object of this invention is to provide a cavity structure having generally planar members with hollow defined therein which cooperate to form resonant cavities.

Yet another object of this invention is to provide a cavity structure that is produced by DXL microfabrication methods.

Additional objects, advantages and novel features of the invention will become apparent to those skilled in the art upon examination of the following and by practice of the invention.

SUMMARY OF THE INVENTION

To achieve the foregoing and other objects, this invention provides a cavity structure which has at least two opposing planar housing members spaced apart to accommodate the passage of the particle beam through the structure between the members. Each of the housing members have a plurality of serially aligned hollows defined therein, and also passages, formed in the members, which interconnect serially adjacent hollows to provide communication between the hollows. The opposing planar housing members are spaced and aligned such that the hollows in one member cooperate with corresponding hollows in the other member to form a plurality of resonant cavities aligned along the particle beam within the cavity structure.

To facilitate the obtaining of a constant field gradient within the cavity structure, the passages are configured so as to be incrementally narrower in the direction of travel of the particle beam. In addition, the spacing distance between the opposing housing members is configured to be incrementally smaller in the direction of travel of the beam. The accelerator structure also includes rf power injection means and spacing and aligning means to space and align the opposing planar housing members.

BRIEF DESCRIPTION OF THE DRAWINGS

The present invention is illustrated in the accompanying drawings where.

Figure 1A:
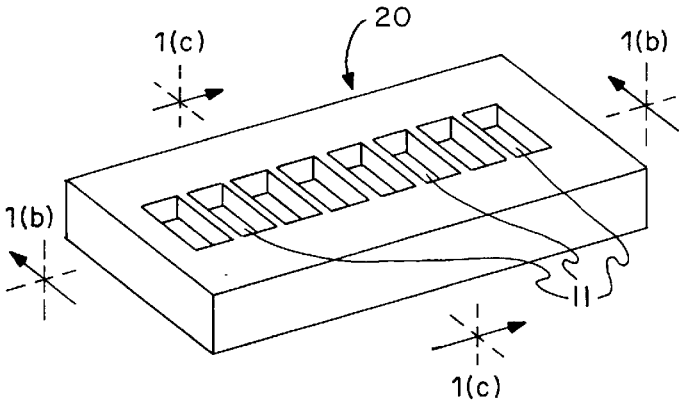
FIG. 1(a) PRIOR ART
FIG. 1(*a*) is an isometric view of a housing member produced by microfabrication methods showing the serially aligned hollows characteristic of the prior art.
Figure 1B:
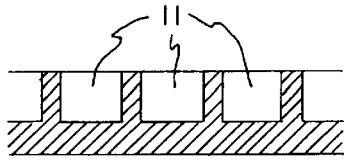
FIG. 1(b) PRIOR ART
Figure 1C:
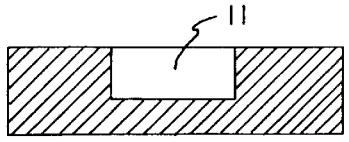
FIG. 1(c) PRIOR ART
Figure 2A:
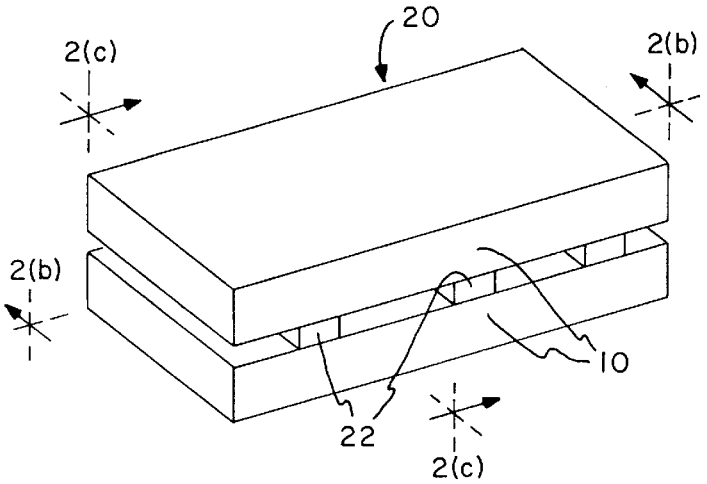
FIG. 2(a) PRIOR ART
Figure 2B:
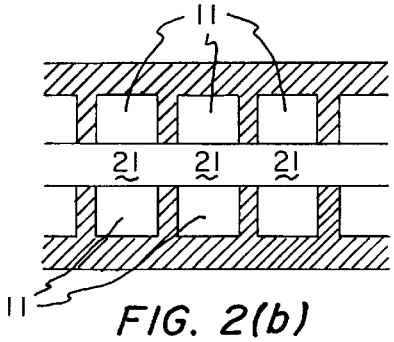
FIG. 2(b) PRIOR ART
Figure 2C:
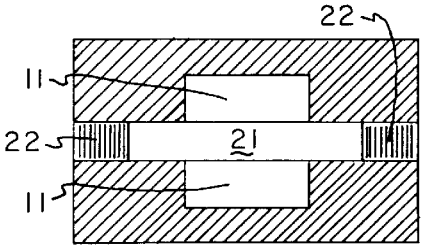
FIG. 2(c) PRIOR ART
Figure 3:
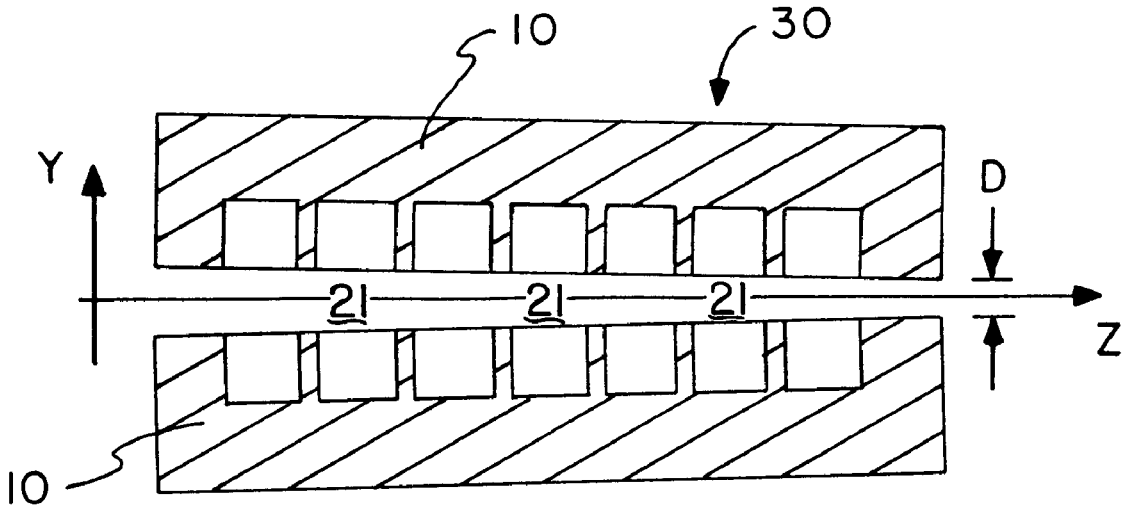
FIG. 3 PRIOR ART

FIGS. l(*b*) and i(*c*) are partial cross-sectional views taken generally along lines 1(*b*)—1(*b*) and 1(*c*)—1(*c*) in FIG. 1(*a*);

FIG. 2(*a*) is an isometric view of a prior art cavity structure formed by placing two of the housing members illustrated in FIG. 1(*a*), in a spaced, opposed relationship to cooperatively form generally cubically shaped resonant cavities between the members;

FIGS. 2(*b*) and 2(*c*) are isometric and cross-sectional views taken generally along lines 2(*b*)—2(*b*) and 1(*c*)—1(*c*) in FIG. 2(*a*);

FIG. 3 is a cross-sectional side view of a simple implementation of a constant gradient cavity structure of the prior art whose vertical distance, D, between the members are varied along the beam axis, Z.

Figure 4:
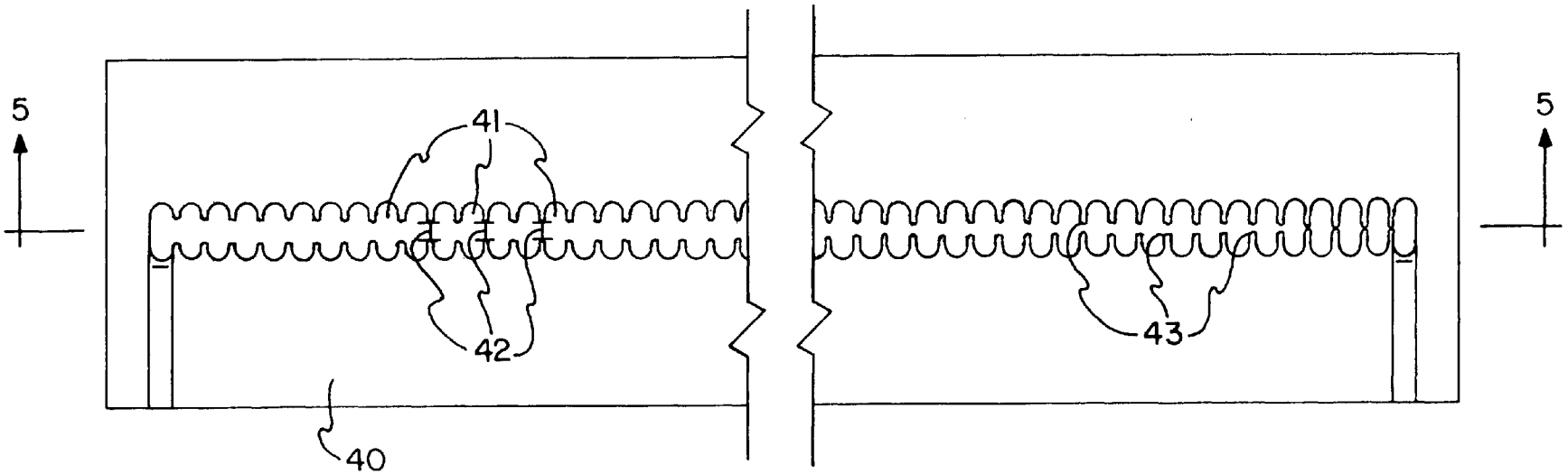

FIG. 4 is a top view of the generally planar housing member of the invention showing serially aligned hollows.

Figure 5:
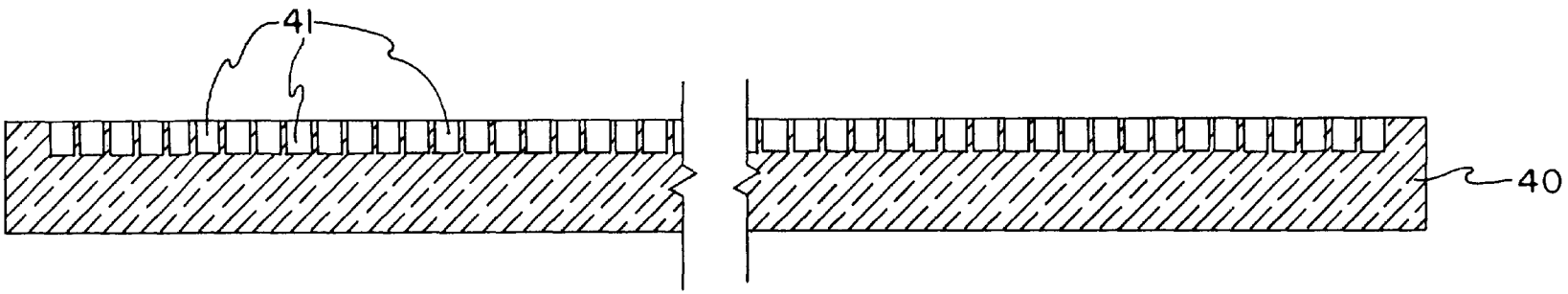
Figure 6A:
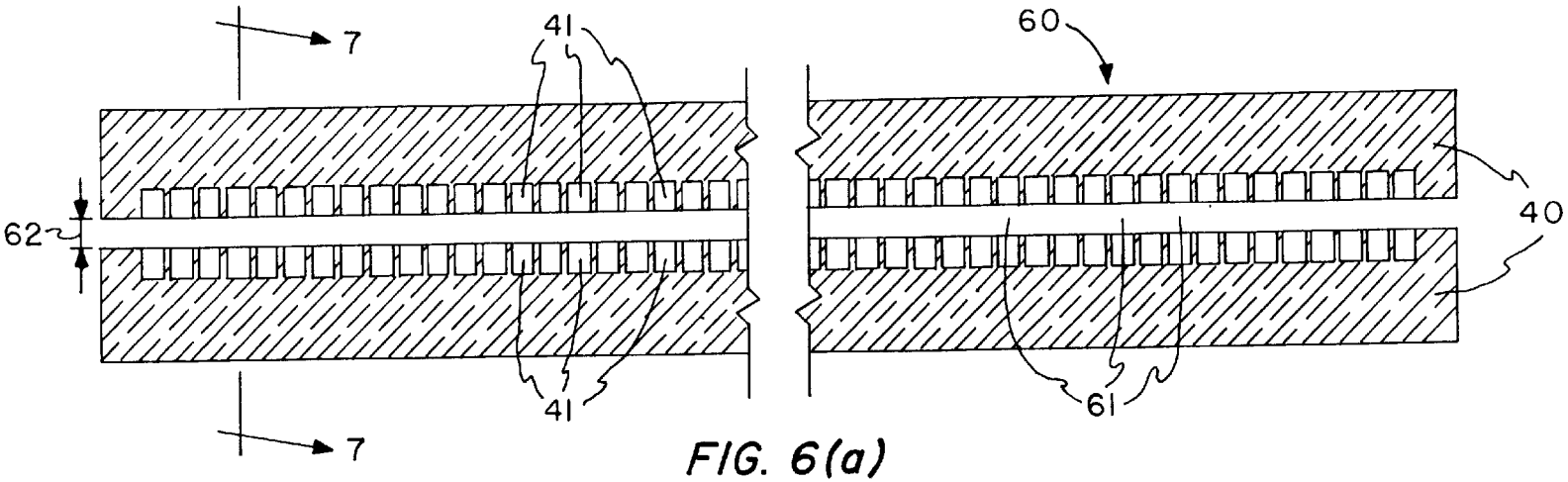
Figure 6B:
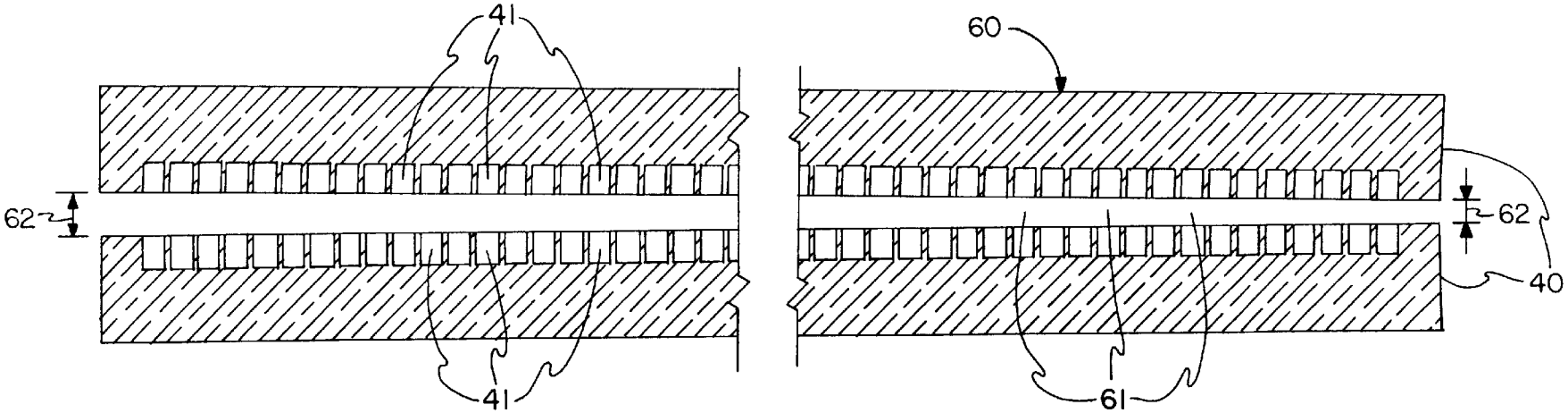
Figure 8A:
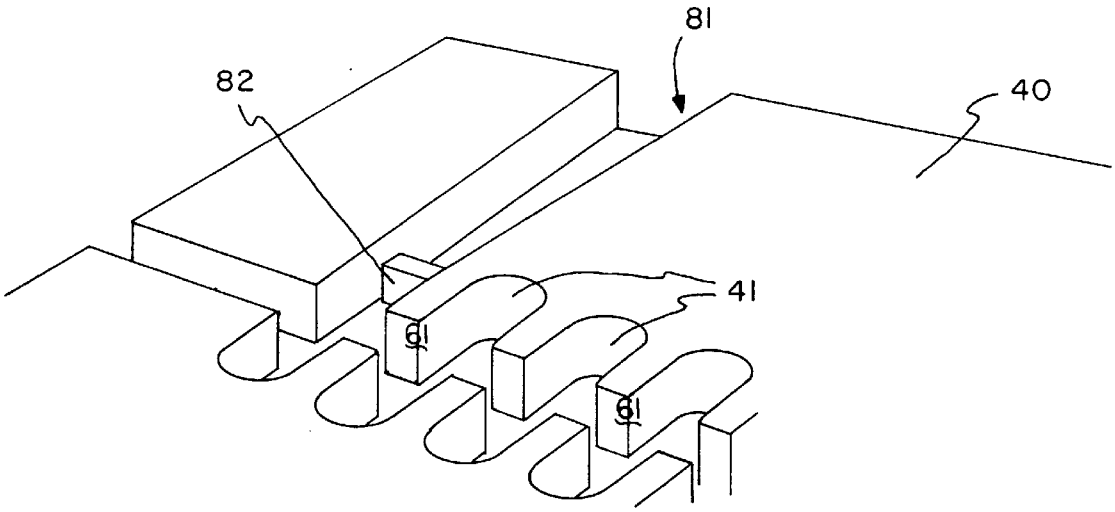
Figure 8B:
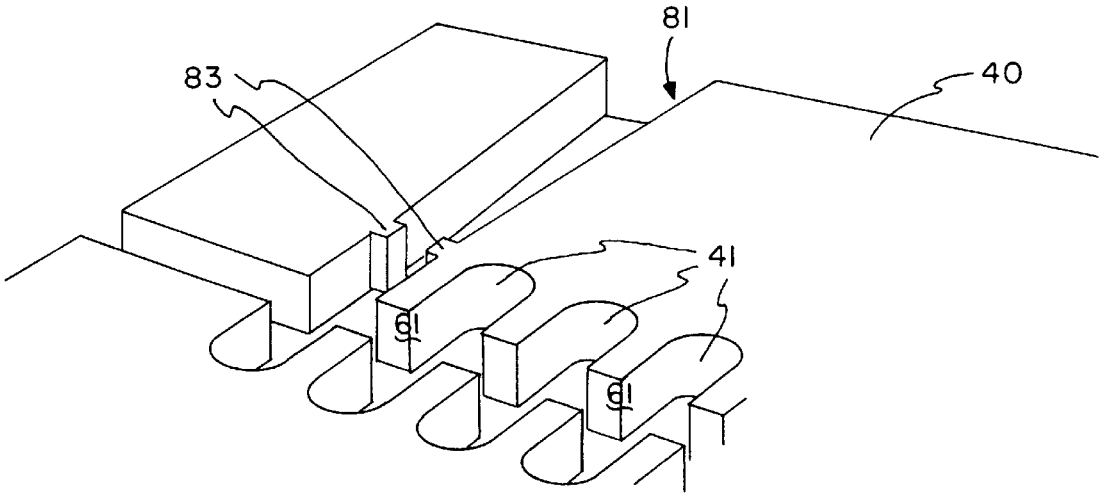
Figure 8C:
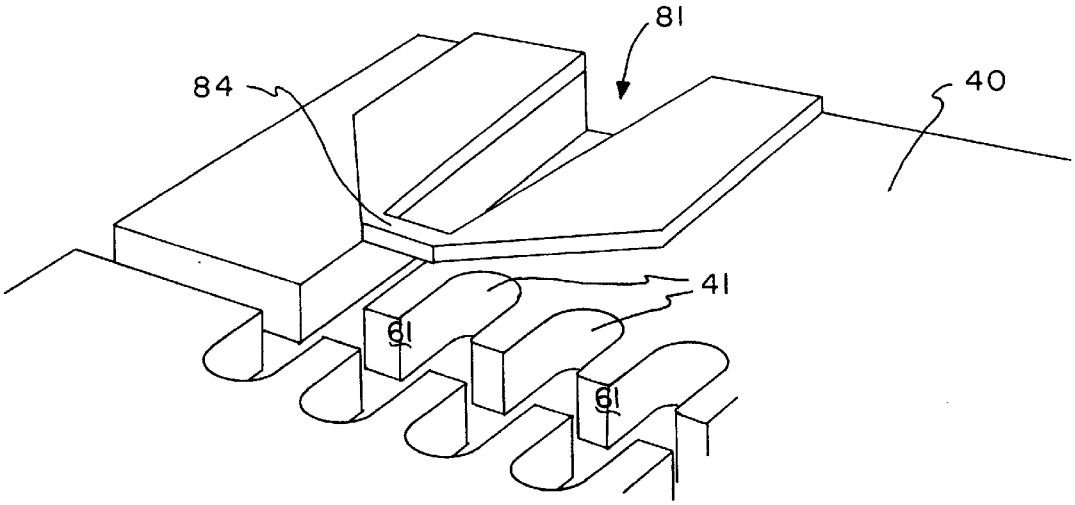
Figure 8D:
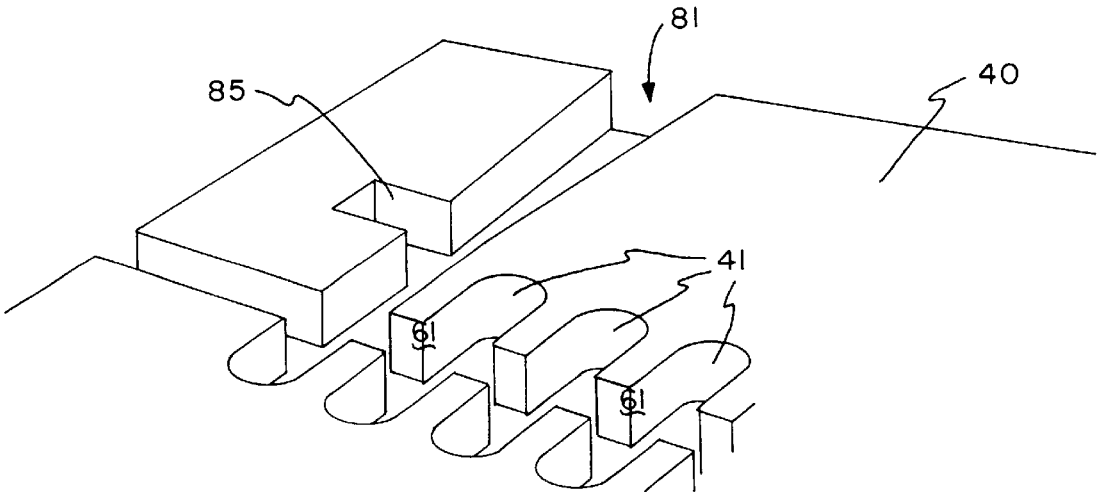

FIG. 5 is a cross-sectional side view of the housing member, taken substantially along line 5—5 in FIG. 4;

FIG. 6(*a*) is a cross-sectional side view of the cavity structure formed by placing two opposing housing members in a spaced, opposed relationship; FIG. 6(*b*) is a cross-sectional side view of the cavity structure illustrating the configuration wherein the distance between the opposing housing members is varied.

Figure 7:
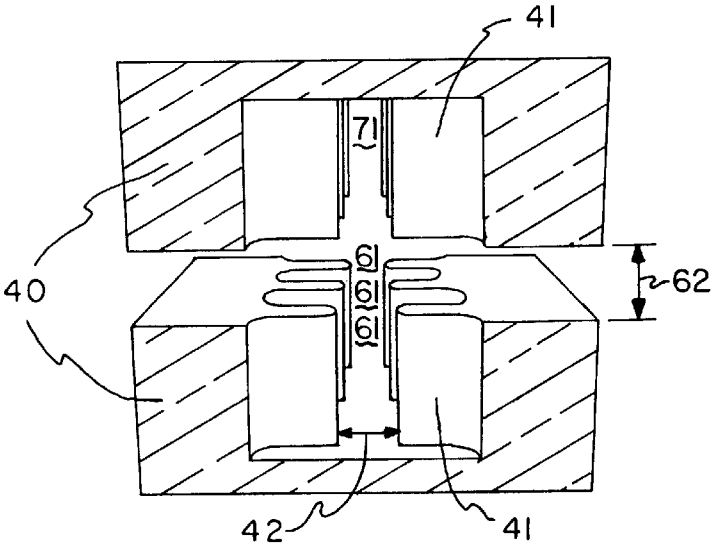
Figure 9:
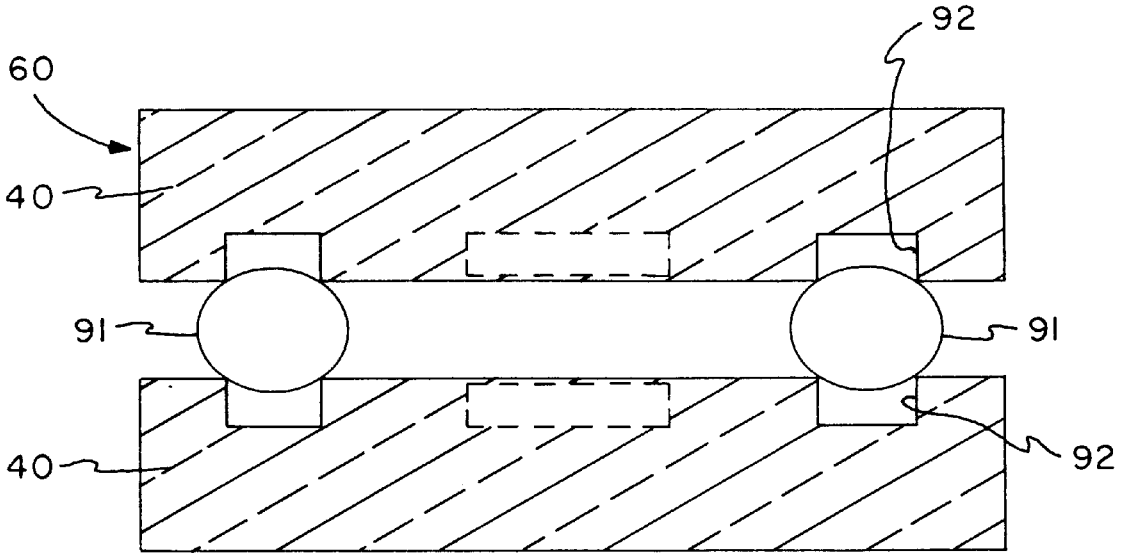

FIG. 7 is a cross-sectional, pictorial end view of the cavity structure, taken substantially along line 7—7 in FIG.6, showing the serially aligned cavities and the openings which interconnect adjacent cavities;

FIGS. 8(*a*)–(*d*) are isometric views of various waveguide couplers which are adapted for use with the cavity structure of this invention wherein FIG. 8(*a*) shows an inductive iris coupling waveguide, FIG. 8(*b*) shows a capacitive iris coupling waveguide, FIG. 8(*c*) shows an inductive post coupling waveguide, and FIG. 8(*d*) shows a series stub coupling waveguide; and FIG. 9 is a cross-sectional view of the cavity structure wherein the housing members are positioned and spaced by means of glass fiber spacers.

Figure 10:
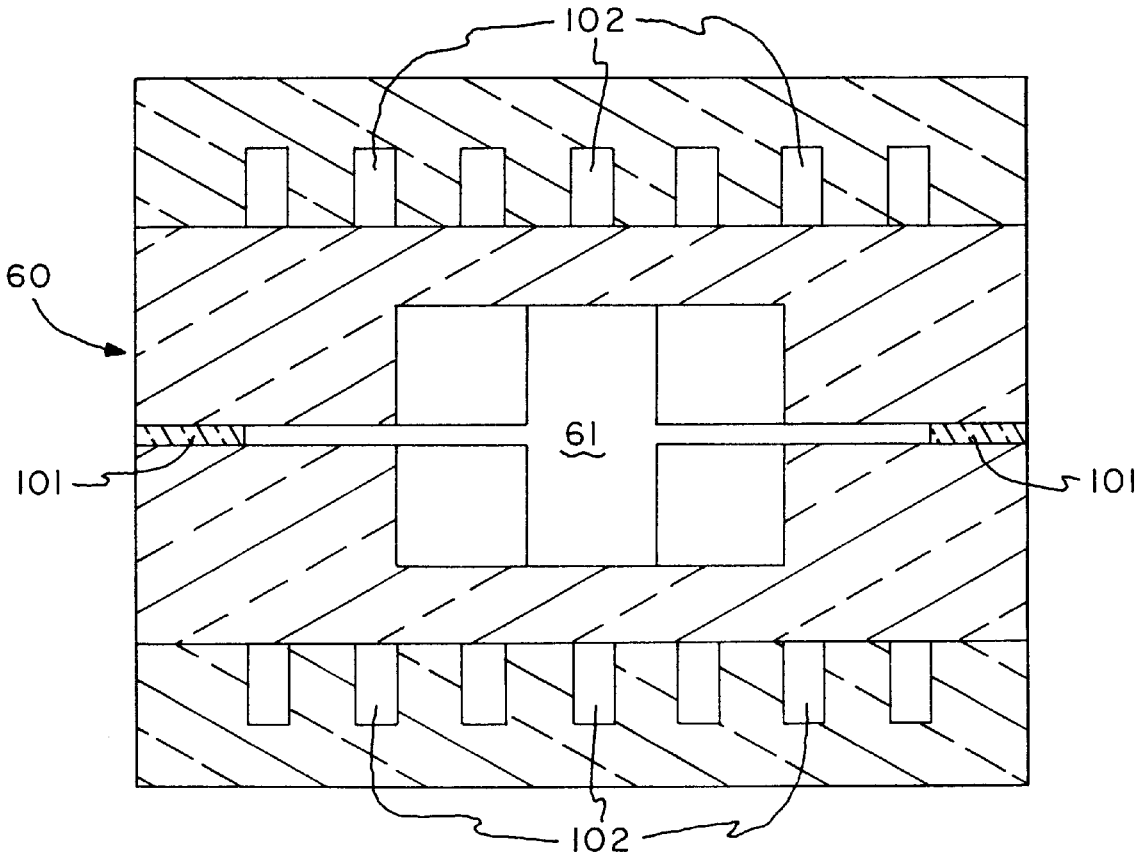

FIG. 10 is a cross-sectional view of the cavity structure illustrating pillars and cooling channels.

DESCRIPTION OF THE PREFERRED EMBODIMENT

As shown generally in FIGS. 4–7, the preferred embodiment of the invention provides a rf cavity structure 60 that is formed by placing two or more generally planar housing members 40 in an opposed, spaced relationship which allows charged particles in a particle beam to pass longitudinally through the structure 60 (see FIG. 6). The cavity structure 60, when injected with rf power, provides a constant electric field gradient for accelerating or otherwise accommodating the charged particles. Compared to prior art constant impedance structures 20 of similar dimensions and operating characteristics, as shown generally in FIGS. 1,2, the constant gradient cavity structure 60 of the present invention has significantly lower heat loading and higher operating powers.

In FIGS. 4 and 5, is shown a detailed view of the housing member 40. Defined within the housing member 40, are serially aligned indentations or hollows 41 which run longitudinally along the middle of the housing member 40. Also defined within the housing member 40 are passages 42 (see FIG. 4) which interconnect serially adjacent hollows 41 and provide communication between the hollows 41.

As shown in FIG. 6, the simplest embodiment of the preferred invention is formed by positioning two identical housing members 40 in a spaced, opposed relationship, such that the corresponding hollows 41 face each other and cooperate in such a manner so as to form elongated, generally cubically shaped resonant cavities 61 having oval shaped ends. The resonant cavities 61 are positioned serially and run longitudinally through the center of the accelerator cavity structure 60. The horizontal width and depth of the cavities 61 are defined by the shape, or dimensions, of the hollows 41, and the vertical height of the cavities 61 are defined by the depth of the hollows 41 plus the aperture height 62, or the distance between the two housing members 40.

As shown more clearly in FIG. 7, when the hollows 41 are aligned to form cavities 61, the passages 42, defined in the housing members 40, are also aligned such that they 42 cooperate to form extended vertical openings 71. The dimensions of the vertical openings 71 are defined by the width and height of the passages 42, plus the aperture height 62. These openings 71 are critical to the invention, since they allow serially adjacent cavities 61 to communicate and become coupled. By adjusting the dimensions of the cavities 61 and vertical openings 71, the cavity-to-cavity coupling can be controlled to achieve a constant field gradient along the beam axis within the cavity structure 60 of the invention.

In the preferred embodiment, the housing member 40 is formed from a metallic substrate using conventional x-ray lithographic methods such as LIGA, as described above in the background of the invention. This process not only can produce members having accurate structural tolerances, about 25–125 angstroms, but can produce them quickly and inexpensively. Further, because conventional machining is not used, the cavity structure 60 is not limited to a metallic substrate and can be made of a wider range of materials.

In the preferred embodiment, as shown in FIGS. 4 and 7, the hollows 41 are configured to be oval in shape and the passages 42 are formed with rounded corners 43 (see FIG. 4). Computer simulation has shown that the oval shapes and rounded corners 43 produce optimum properties for achieving the desired electric and magnetic field distributions, shunt impedance, and power density. However, the shape of the hollows 41 need not be limited to such and can be varied as desired to achieve the desired performance characteristics of the cavities 61 which are formed by the hollows 41.

Additionally, the width of the passage 42, and consequently the width of the openings 71, can also be adjusted to achieve the desired cavity-to-cavity coupling. In the preferred embodiment, the width of the openings 71 are greatest at the input end of the cavity structure 60 and become incrementally narrower towards the output end of the structure 60, or in the direction of travel of the beam. This gradual variance in the width of the openings 71 along the longitudinal axis of the cavity structure 60 regulates the cavity-to-cavity coupling and facilitates the attainment of a constant field gradient within the structure 60. This ability to adjust the width of the openings 71 is very important, because, with the housing members 40 being produced by lithographic means, it is very difficult to vary the depth of the hollows 41 which control the total vertical height of the openings 71.

Since the cavity structure 60 of the invention is constructed using two or more housing members 40, the aperture height 62, or the distance between the members 40, can be varied to obtained the desired cavity coupling and/or field gradient. The aperture height 62 directly affects cavity-to-cavity coupling, such that coupling is increased as the aperture height 62 is increased and, conversely, decreased as the aperture height 62 is reduced. In the preferred embodiment, the aperture height 62 is smaller at the output end of the cavity structure 60 than at the input end to reduce cavity-to-cavity coupling towards the output end and facilitate a more constant field gradient within the cavity structure 60.

External RF power can be injected into the cavity structure 60 by various conventional means such as coaxial transmission line couplers or waveguide couplers. In the preferred embodiment, as shown generally in FIGS. 8(*a*)–(*d*), the hollows 41, and consequently the cavities 61, are fed using waveguides 81, which are defined within the housing member 40. In FIG. 8(*a*) is shown an inductive iris coupling waveguide 81, which uses an inductive matching iris 82. In FIG. 8(*b*) is shown a capacitive iris coupling waveguide 81, which uses capacitive matching irises 83. In FIG. 8(*c*) is shown an inductive post coupling waveguide 81, which uses an inductive matching post 84. In FIG. 8(*d*) is shown a series stub coupling waveguide 81, which uses waveguide matching stub 85.

In general, the waveguides 81 are adapted to being made using DXL microfabrication methods and is normally formed at the same time the hollows 41 and passages 42 are produced. The waveguides 81 are normally connected to the first cavity 61 of the cavity structure 60, which are also referred to as coupling cells. For optimal performance, the waveguide should facilitate impedance matching and be able to handle high voltages.

A 1.5 meter electron linear accelerator system, constructed using the cavity structure 60 of the invention, will require the aligning and joining of some forty housing members 40, which each 7.5 cm long. The housing members 40 will be required to be positioned in an opposed, spaced relationship and be properly aligned in both the vertical and horizontal direction. In order to achieve efficient coupling between the fields and electrons, all structural dimensions should be controlled to about a 0.1% accuracy. To assemble such an accurate system, the housing members 40 can be positioned using various known techniques such as, optical fibers in silicon v-grooves, optical fibers in electroplated rectangular grooves, and DXL generated pegs or pillars 101 (see FIG. 10). The first technique has been shown to be effective in achieving the necessary accuracy, but it involves an extra masking step. The other two techniques have also been shown to feasible in constructing the cavity structure 60 of the invention.

In the preferred embodiment, as shown in FIG. 9, the housing members 40 are positioned and spaced by means of glass fiber spacers 91 placed within DXL generated grooves 92 defined within the housing members 40. The grooves 92 are rectangular in shape and run longitudinally along the direction of the particle beam.

At high power operation, the cavity structure 60 may require cooling to maintain stable and reliable operations. One method of obtaining such cooling is to place cooling channels 102 (see FIG. 10) along the length of each of the housing members 40. With such a cooling channels in place, the constant gradient cavity structure 60 of this invention may be able to operate at even higher power levels.

The foregoing description of a preferred embodiment of the invention has been presented for purposes of illustration and description. It is not intended to be exhaustive or to limit the invention to the precise form disclosed. For example, the shapes and/or the sizes of the generally planar housing member 40, as well as the hollows 41 and passages 42 defined therein, need not be restricted to the shapes and sizes described in the preferred embodiment and can be varied as needed to form the resonant cavities 61 with the desired operating frequency and coupling characteristics. The embodiment described herein explains the principles of the invention so that others skilled in the art may practice the invention in various embodiments and with various modifications as suited to the particular use contemplated. It is intended that the scope of the invention be defined by the claims appended hereto.

We claim:

1. A cavity structure including at least two opposing housing members spaced apart to accommodate the passage of a particle beam, having a direction of travel, through the structure, between the members, each of said housing members having a plurality of serially aligned hollows defined therein, said respective hollows configured to define partition walls between each adjacent hollow and said partition walls including respective passages with a defined width, provided in the corresponding partition walls and interconnecting said serially adjacent hollows to provide communication between the hollows, such that said serially aligned hollows in one of said member cooperates with the corresponding hollows in the other one of said housing member to provide a plurality of resonant cavities aligned along the direction of travel of the particle beam within the cavity structure, and wherein the respective passages are configured to be incrementally smaller in width along the direction of travel of the particle beam.

2. The cavity structure of claim 1 and further including cooling channels defined within the housing members.

3. The cavity structure of claim 1 wherein the opposing housing members are spaced in such manner as to provide a distance between the housing members which is incrementally smaller in the direction of travel of the particle beam.

4. The cavity structure of claim 1 wherein said plurality of hollows are generally oval in shape.

5. The cavity structure of claim 1 wherein said respective passages have rounded corners.

6. The cavity structure of claim 1 and means for spacing and aligning said opposing housing members positioned within the cavity structure and between the housing members, said means for spacing and aligning said opposing housing members being configured so as to accommodate the passage of the particle beam between the members and allow the respective hollows to cooperatively provide said plurality of resonant cavities aligned along the particle beam.

7. The cavity structure of claim 6, wherein said means for spacing and aligning includes glass fiber spacers positioned within respective longitudinal grooves defined within said opposing housing members.

8. The cavity structure of claim 6, wherein said means for spacing and aligning said opposing housing members includes DXL generated pegs on the respective housing members which connect, space and align opposing housing members.

9. The cavity structure of claim 1 and means for injecting rf power connected to said cavity structure.

10. The cavity structure of claim 9 wherein said means for injecting rf power is connected to respective hollows and includes waveguide couplers defined within the corresponding housing members.

11. The cavity structure of claim 10 wherein said waveguide couplers are selected from a group consisting of inductive iris coupling; capacitive iris coupling; inductive post coupling; and series stub coupling.

12. A cavity structure for accommodating the passage of a particle beam, having a direction of travel, through the structure, said cavity structure being configured to provide a plurality of resonant cavities aligned along the direction of travel of the particle beam, said resonant cavities having openings which interconnect serially adjacent cavities to provide cavity-to-cavity coupling, and said respective openings configured to be incrementally smaller in the direction of travel of the beam.

13. The cavity structure of claim 12, wherein said openings are configured so as to facilitate the attainment of a constant field gradient within the cavity structure.

14. A cavity structure including at least two opposing housing members spaced apart to accommodate the passage of a particle beam, having a direction of travel, through the structure and between the members, each of said housing members having a plurality of serially aligned hollows defined therein, with said respective hollows configured to define partition walls between each adjacent hollow and said partition walls including respective passages provided in the corresponding partition walls and interconnecting said serially adjacent hollows to provide communication between the hollows, such that said serially aligned hollows in one of said member cooperates with the corresponding hollows in the other one of said housing member to provide a plurality of resonant cavities aligned along the particle beam direction within the cavity structure, and wherein said hollows, partition walls, and passages provided in said corresponding housing members are manufactured using x-ray lithographic processes.

15. The cavity structure of claim 14 wherein the respective passages are configured to be incrementally smaller in the direction of travel of the particle beam.

* * * * *